US009777433B2

(12) United States Patent
Takamori et al.

(10) Patent No.: US 9,777,433 B2
(45) Date of Patent: Oct. 3, 2017

(54) SHOE PRESS BELT

(71) Applicant: Ichikawa Co., Ltd., Bunkyo-ku (JP)

(72) Inventors: Yuya Takamori, Bunkyo-ku (JP); Nobuharu Suzuki, Bunkyo-ku (JP); Mitsuyoshi Matsuno, Bunkyo-ku (JP); Chie Umehara, Bunkyo-ku (JP); Taichi Sakai, Bunkyo-ku (JP)

(73) Assignee: Ichikawa Co., Ltd., Bunkyo-ku (JP)

( * ) Notice: Subject to any disclaimer, the term of this patent is extended or adjusted under 35 U.S.C. 154(b) by 0 days.

(21) Appl. No.: 15/170,107

(22) Filed: Jun. 1, 2016

(65) Prior Publication Data

US 2016/0355978 A1 Dec. 8, 2016

(30) Foreign Application Priority Data

Jun. 5, 2015 (JP) ..... 2015-125129

(51) Int. Cl.
*D21F 3/02* (2006.01)

(52) U.S. Cl.
CPC ..... *D21F 3/029* (2013.01); *D21F 3/0227* (2013.01); *D21F 3/0236* (2013.01)

(58) Field of Classification Search
CPC ..... D21F 3/029; D21F 3/02; D21F 3/0236; D21F 3/0227
USPC ..... 162/358.1
See application file for complete search history.

(56) References Cited

U.S. PATENT DOCUMENTS

| | | | |
|---|---|---|---|
| 2004/0029474 | A1 | 2/2004 | Watanabe et al. |
| 2010/0147480 | A1 | 6/2010 | Yazaki et al. |
| 2010/0186920 | A1 | 7/2010 | Yazaki et al. |

FOREIGN PATENT DOCUMENTS

| | | |
|---|---|---|
| JP | 2002-146694 | 5/2002 |
| JP | 2008-111220 | 5/2008 |
| JP | 2008-285784 | 11/2008 |
| JP | 2012-511611 | 5/2012 |
| WO | WO 2010/066950 A2 | 6/2010 |

*Primary Examiner* — Mark Halpern
(74) *Attorney, Agent, or Firm* — Oblon, McClelland, Maier & Neustadt, L.L.P.

(57) ABSTRACT

A shoe press belt with excellent mechanical properties, in particular a shoe press belt with excellent crack resistance and excellent resistance to land edge deficiency. The shoe press belt includes a felt-side resin layer containing a resin formed by curing a prepolymer having a terminal isocyanate group (—NCO) with a curing agent, wherein the prepolymer contains, in reacted form, a compound comprising 1,4-bis (isocyanate methyl) cyclohexane and a polycarbonate diol, and wherein the felt-side resin layer has grooves that are configured to receive water squeezed from a felt.

7 Claims, 4 Drawing Sheets

SHOE PRESS BELT

TECHNICAL FIELD

The present invention relates to a shoe press belt for use in a papermaking machine and a method of manufacturing the same.

DESCRIPTION OF THE RELATED ART

Papermaking machines for removing moisture from the source material of paper are generally equipped with a wire part, a press part and a dryer part. These parts are arranged in the order of wire part, press part and dryer part in the wet paper web transfer direction.

The wet paper web is dewatered and, at the same time, transferred while being passed between papermaking equipment provided in the wire part, press part and dryer part, respectively, to be finally dried in the dryer part. In each of these parts, papermaking equipment is used which corresponds to the functions of dewatering the wet paper web (wire part), squeezing water from the wet paper web (press part), and drying the wet paper web (dryer part), respectively.

The press part is generally equipped with one or more press devices arranged in series in the wet paper web transfer direction. Each press device comprises an endless felt or an open-ended felt that has been formed into an endless felt by connecting it in the papermaking machine. Each press device also comprises a roll press mechanism made of a pair of rolls, which face each other, or a shoe press mechanism, in which an endless shoe press belt is interposed between a roll and a concave shoe facing said roll. Moisture is squeezed from the wet paper web by compressing the felt, onto which the wet paper web has been placed, when it passes the roll press mechanism or the shoe press mechanism while it is being moved in the wet paper web transfer direction, whereby the moisture from the wet paper web is continuously absorbed by the felt or it is discharged to the outside by passing through the felt.

In the shoe press belt, a reinforcing base material is embedded in resin and the resin constitutes an outer circumferential layer contacting the felt and an inner circumferential layer contacting the shoe. The shoe press belt runs repeatedly between the roll and the shoe onto which pressure is applied; therefore, mechanical properties such as wear resistance, crack resistance, resistance to land edge deficiency, flexural fatigue resistance, heat resistance, and the like, are required of the resin of the shoe press belt. Various shoe press belt resins have been investigated in order to improve these required properties (for example, in Patent Documents 1 to 4).

Patent Documents 1 to 3 investigate belts in which mechanical properties such as heat resistance, crack resistance, flexural fatigue resistance, wear resistance, and the like, are improved by selecting particular isocyanates and curing agents for the polyurethane.

PRIOR ART DOCUMENTS

Patent Documents

Patent Document 1: JP-A-2012-511611

Patent Document 2: JP-A-2008-285784

Patent Document 3: JP-A-2008-111220

Patent Document 4: JP-A-2002-146694

SUMMARY OF THE INVENTION

Problems to be Solved by the Invention

Although various mechanical properties have been improved in the shoe press belts according to the beforementioned Patent Documents 1 to 4, an even greater improvement of mechanical properties, in particular crack resistance, is required of shoe press belts in an operational environment of papermaking machines which, due to productivity improvements in papermaking, increases in severity together with the increase in operation speed and the increase of pressure in the press section.

Moreover, a further improvement of the resistance to land edge deficiency, which is due to the shear stress the shoe press belt is subjected to when it is pressed by the roll and the shoe, is also required. The term crack here refers to the fractures occurring in a shoe press belt, and the term land edge deficiency refers to the wearing away of the land edge parts formed between the groove walls of the drainage grooves and the felt-contacting surface of the groove land part, which is due to the shear stress from the repeated compression.

Accordingly, it is an object of the present invention to provide a shoe press belt with excellent mechanical properties, in particular a shoe press belt with excellent crack resistance and excellent resistance to land edge deficiency, and to provide a method of manufacturing the same.

Means for Solving the Problems of the Invention

The present inventors, as a result of intensive studies in order to achieve the above object, found that excellent crack resistance and excellent resistance to land edge deficiency can be achieved by forming the resin layer constituting the felt-side layer of the shoe press belt by curing a compound comprising 1,4-bis(isocyanate methyl) cyclohexane. The present inventors have thus completed the invention.

Accordingly, the present invention relates to the following.

[1] A shoe press belt for use in a papermaking machine, wherein it comprises a felt-side resin layer which is constituted by a resin layer and in which grooves for receiving water squeezed from a felt are formed, and wherein the felt-side resin layer is formed by curing a compound comprising 1,4-bis(isocyanate methyl) cyclohexane.

[2] A shoe press belt according to [1], wherein the hardness (JIS-A) of the felt-side resin layer is 90 degrees or more.

[3] A shoe press belt according to [1] or [2], wherein the mechanical strength index of the resin material constituting the felt-side resin layer, which is expressed by formula (1) below, is 10 (MPa·strokes/μm) or more.

$$\text{Mechanical strength index(MPa·strokes/μm)}=A\times B/C \quad (1),$$

wherein

A=tensile strength (MPa),

B=tensile elongation (%) and

C=de Mattia type crack growth rate (μm/stroke).

[4] A shoe press belt according to any one of [1] to [3], wherein the mechanical strength index of the resin material constituting the felt-side resin layer, which is expressed by formula (1), is 25 (MPa·strokes/μm) or more.

[5] A shoe press belt according to any one of [1] to [4], wherein the mechanical strength index of the resin material constituting the felt-side resin layer, which is expressed by formula (1), is 50 (MPa·strokes/μm) or more.

[6] A shoe press belt according to any one of [1] to [5], wherein the felt-side resin layer is formed by curing a compound mixed from a prepolymer having a terminal isocyanate group (—NCO) and a curing agent having a terminal active hydrogen group (—H), wherein the equivalent ratio (H/NCO) of the active hydrogen group (—H) and the isocyanate group (—NCO) is from 0.8 or more to 1.0 or less.

[7] A shoe press belt according to any one of [1] to [6], wherein the polyol of the resin material constituting the felt-side resin layer comprises one or more compounds selected from polycarbonate diol, polytetramethylene glycol.

[8] A shoe press belt according to any one of [1] to [7], wherein the curing agent of the resin material constituting the felt-side resin layer comprises one or more compounds selected from 1,4-butanediol, trimethylol propane, glycerine, 4,4'-methylenebis(3-chloro-2,6-diethylaniline), 1,4-cyclohexane dimethanol.

Advantages of the Invention

According to the above constitution, it is possible to provide a shoe press belt with excellent mechanical properties, in particular crack resistance and resistance to land edge deficiency, and a method of manufacturing the same.

MODES FOR CARRYING OUT THE INVENTION

Figure 1:
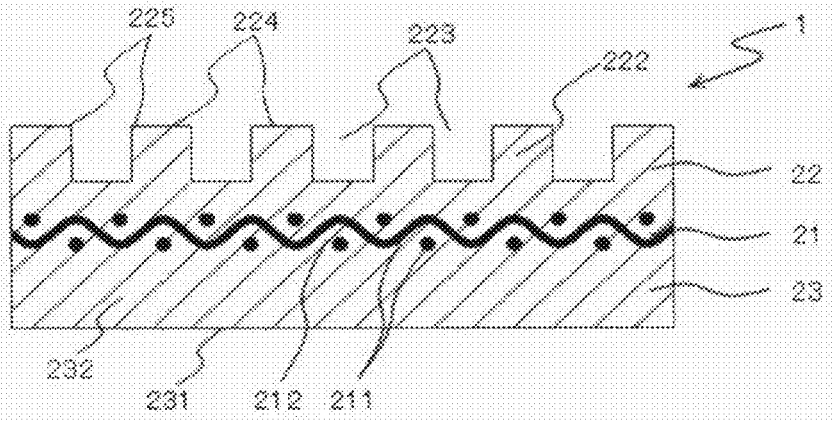
FIG. 1 is a sectional view in the cross-machine direction showing one example of a shoe press belt related to a preferred embodiment of the present invention.

Hereinafter, preferred embodiments of the shoe press belt according to the present invention and a method of manufacturing the same will be explained in detail by referring to the drawings.

First, a shoe press belt according to the present invention will be explained.

FIG. 1 is a sectional view in the cross-machine direction showing one example of a shoe press belt related to a preferred embodiment of the present invention. In the figures, the size of each member is appropriately emphasized to facilitate explanation; this does not represent the actual size or proportion of the different members. Here, the above mentioned cross-machine direction is also referred to as "CMD" and the machine direction is also referred to as "MD".

The shoe press belt 1 shown in FIG. 1 is used in the press part of a papermaking machine to transfer the wet paper web in cooperation with a felt and to squeeze moisture from the wet paper web. The shoe press belt 1 is an endless belt. In other words, the shoe press belt 1 is an annular belt. The shoe press belt 1 is normally arranged with its circumferential direction extended along the machine direction (MD) of a papermaking machine.

The shoe press belt 1 shown in FIG. 1 comprises a reinforcing fibrous base material layer 21, a felt-side resin layer 22 provided on one of the main surfaces of the reinforcing fibrous base material layer 21 at the outer surface side thereof, and a shoe-side resin layer 23 provided on the other main surface of the reinforcing fibrous base material 21 at the inner surface side thereof. The shoe press belt 1 is formed by laminating these layers.

The reinforcing fibrous base material 211 is not particularly limited; however, a woven fabric woven made, for example, by a weaving machine, and the like, from warp and weft yarns, is generally used. Moreover, it is also possible to use a grid-like material made by superimposing rows of warp and weft yarns without weaving.

The fineness of the fibers constituting the reinforcing fibrous base material 211 is not particularly limited; however, for example, fibers of 300 to 10,000 dtex, preferably 500 to 6,000 dtex, may be used.

Moreover, the fineness of the fibers constituting the reinforcing fibrous base material 211 may be different according to the part in which they are used. For example, the fineness of the warp yarns of the reinforcing base material 211 may be different from that of the weft yarns.

As material used as reinforcing fibrous base material 211, it is possible to use one or a combination of two or more of a polyester (polyethylene terephthalate, polybutylene terephthalate, and the like), an aliphatic polyamide (polyamide 6, polyamide 11, polyamide 12, polyamide 612, and the like), an aromatic polyamide (aramide), polyvinylidene fluoride, polypropylene, polyetheretherketone, polytetrafluoroethylene, polyethylene, wool, cotton, metals, or the like.

Examples of urethane resins used in a resin 222 of the felt-side resin layer (the resin layer comprising drainage grooves 223 and land surfaces 224 contacting the felt) 22 include polymers of a JIS-A hardness of 90 to 99 degrees, preferably 93 to 98 degrees, which are obtained by curing a composition mixed from an urethane prepolymer comprising a terminal isocyanate group (—NCO), obtained by reacting 1,4-bis(isocyanate methyl) cyclohexane (hereinafter referred to as "H6XDI") and a polyol, with a curing agent comprising an active hydrogen group (—H) at an equivalent ratio (H/NCO) value of 0.9 or more to 1.0 or less of the active hydrogen group of the curing agent to the isocyanate group of the urethane prepolymer.

As isocyanate compound of the urethane prepolymer source material, H6XDI can be used in an amount of 55 to 100 mol %, preferably 75 mol % or more, in the isocyanate compound; as isocyanate compounds other than H6XDI, p-phenylene-diisocyanate (PPDI), 2,4-tolylene-diisocyanate (2,4-TDI), 2,6-tolylene-diisocyanate (2,6-TDI), 4,4'-methylenebis(phenyl isocyanate) (MDI), 1,5-naphthalene-diisocyanate (NDI) can be used in combination in an amount of 45 mol % or less, preferably 25 mol % or less.

As polyols of the urethane prepolymer source material, it is possible to use one or more compounds selected from polytetramethylene glycol (PTMG), polyoxypropylene glycol (PPG), polycaprolactone diol (PCL), polyethylene adipate (PEA), trimethylolpropane (TMP), polycarbonate diol (PCD); preferably one or more compounds selected from polycarbonate diol (PCD) and polytetramethylene glycol (PTMG) are used.

As curing agent, it is possible to use one or more compounds selected from ethylene glycol, 1,3-propanediol, 1,4-butanediol, 1,5-pentanediol, 1,6-hexanediol, hydroquinone bis-β hydroxyl ethyl ether, cyclohexane dimethanol, trimethylolpropane, glycerol, butane triol, cyclohexane triol, triethanolamine, diethyl toluene diamine, dimethylthiotoluenediamine, 4,4'-bis(2-chloroaniline), 4,4'-methylenebis(3-chloro-2,6-diethylaniline), 4,4'-bis (sec-butylamino)-diphenylmethane, N,N'-dialkyl-diaminodiphenyl methane, 4,4'-methylenedianiline, 4,4'-methylene-bis(2,3-dichloroaniline), 4,4'-methylene-bis(2-chloroaniline), 4,4'-methylene-bis(2-ethyl-6-methylaniline), trimethylene-bis(4-amino-benzoate) and phenylenediamine; preferably one or more compounds selected from 1,4-butanediol (BD), trimethylolpropane (TMP), glycerol (Gly), 4,4'-methylenebis(3-chloro-2,6-diethylaniline) (MCDEA), 1,4-cyclohexanedimethanol (CHDM) are used.

Moreover, it is possible to comprise one or a combination of two or more inorganic fillers such as titanium oxide, kaolin, clay, talc, diatomaceous earth, calcium carbonate, calcium silicate, magnesium silicate, silica, mica, and the like, in the resin 222.

The reinforcing fibrous base material layer 21 is made of the reinforcing fibrous base material 211 and a resin 212. The resin 212 is present in the reinforcing fibrous base material layer 21 so as to fill the gaps of the fibers in the reinforcing fibrous base material 211. In other words, one part of the resin 212 impregnates the reinforcing fibrous base material 211 while the reinforcing fibrous base material 211 is embedded in the resin 212. Further, the type and constitution of the resin 212 in the reinforcing fibrous base material layer 21 may be different in each part of the reinforcing fibrous base material layer 21 or they may be the same in all parts.

As material for the resin 212 constituting the reinforcing fibrous base material layer 21, it is possible to use one or a combination of two or more thermosetting resins such as urethane, epoxy, acryl, and the like, or thermoplastic resins such as polyamide, polyacrylate, polyester, and the like; preferably, urethane resin is used.

The urethane resin used in the resin 212 is not particularly limited; however, it is possible to use, for example, urethane resin obtained by curing a urethane prepolymer having a terminal isocyanate group, which was obtained by reacting an aromatic or aliphatic polyisocyanate compound and polyol, together with a curing agent having an active hydrogen group. Moreover, it is possible to use aqueous urethane resin. In this case, it is also possible to use a cross linking agent together with the aqueous urethane resin and to crosslink the aqueous urethane resin.

In addition, it is further possible to use one type or a combination of two or more types of the resin materials that can be used in the above-mentioned felt-side resin layer 22. The type and constitution of the resin material constituting the reinforcing fibrous base material layer 21 and the type and constitution of the resin material constituting the felt-side resin layer 22 may be the same or may be different.

Moreover, the reinforcing fibrous base material layer 21 may also comprise one or more inorganic fillers in the same way as the felt-side resin layer 22.

Further, the type and constitution of the resin materials and the inorganic fillers in the reinforcing fibrous base material layer 21 may be different in each part of the reinforcing fibrous base material layer 21 or they may be the same in all parts.

The shoe-side resin layer (the resin layer having a shoe-contacting surface 231 for contacting the shoe) 23 is provided on one of the main surfaces of the reinforcing fibrous base material layer 21 and is primarily made of a resin material.

The shoe-side layer 23 constitutes the shoe-contacting surface 231 for contacting the shoe on the main surface at the opposite side of the main surface that is joined to the reinforcing fibrous base material layer 21. When the shoe press belt 1 is used, the shoe-contacting surface 231 for contacting the shoe is pressed by the shoe, and in cooperation with a roll facing the shoe, the wet paper web, the felt and the shoe press belt are pressed; thereby, moisture is squeezed from the wet paper web.

As resin material constituting the shoe-side resin layer 23, it is possible to use one type or a combination of two or more types of the resin materials that can be used in the above-mentioned reinforcing fibrous base material layer 21. The type and constitution of the resin material constituting the shoe-side resin layer 23 may be the same as the type and constitution constituting the felt-side resin layer 22 or the reinforcing fibrous base material layer 21, or they may be different.

From the point of view of mechanical strength, wear resistance and flexibility, in particular, urethane resins are preferred as resin material constituting the shoe-side resin layer 23.

Moreover, the shoe-side resin layer 23 may also comprise one or more inorganic fillers in the same way as the felt-side resin layer 21.

Further, the type and constitution of the resin materials and the inorganic fillers in the shoe-side resin layer 23 may be different in each part of the shoe-side resin layer 23 or they may be the same in all parts.

The dimensions of the shoe press belt 1 described above are not particularly limited; they may be suitably set according to the use of the wet paper web transfer belt.

The width of the shoe press belt 1 is not particularly limited; however, it may, for example, be 700 to 13,500 mm, or preferably 2,500 to 12,500 mm.

Further, the length (circumferential length) of the shoe press belt 1 is not particularly limited; however, it may, for example, be 150 to 600 cm, or preferably 200 to 500 cm.

Moreover, the thickness of the shoe press belt 1 is not particularly limited; however, it may, for example, be 1.5 to 7.0 mm, or preferably 2.0 to 6.0 mm.

Further, the shoe press belt 1 may have a different thickness in each place or it may have the same thickness in all places.

By forming the drainage grooves in the felt-side layer of the shoe press belt 1 illustrated in FIG. 1, it is possible to increase the amount of moisture that can be removed from the wet paper web. The configuration of the drainage grooves in not particularly limited; however, a plurality of parallel and continuous grooves is generally formed in the machine direction of the shoe press belt. For example, it is possible to set the groove width at 0.5 to 2.0 mm, the groove depth at 0.4 to 2.0 mm, and the number of grooves at 5 to 20 grooves per inch. Moreover, the sectional shape of the grooves may be suitably set to a rectangular, trapezoidal or U-shape, or the parts connecting the land parts, the bottom parts and the groove walls may be rounded, and the like.

Furthermore, the groove width, the groove depth, the number of grooves and the sectional shape may be the same for all drainage grooves, or different configurations may be combined. Further, these drainage grooves may also be formed as non-continuous grooves; a plurality of parallel grooves may also be formed in the cross-machine direction.

When drainage grooves are formed in this way, the corner parts (land edge parts) 225 constituted by the groove walls and the felt-contacting surface 224 of the groove land parts are formed at the same time.

The shoe press belt 1 described above can be manufactured according to the manufacturing method of a shoe press belt according to the present invention described hereinafter.

The shoe press belt 1 relating to the above embodiment can improve the mechanical properties, in particular, the crack resistance and the resistance to land edge deficiency.

Next, preferred embodiments of methods for manufacturing a shoe press belt according to the present invention will be explained. FIGS. 2 to 5 are schematic views for explaining preferred embodiments of methods for manufacturing a shoe press belt according to the present invention.

The method of manufacturing a shoe press belt relating to an embodiment of the present invention is a method of manufacturing a shoe press belt for carrying a wet paper web via a felt, transporting the wet paper web, and squeezing moisture from the wet paper web; wherein it comprises a resin layer forming step for forming the felt-side resin layer (precursor of the felt-side resin layer), the reinforcing fibrous base material and the resin layer of the shoe-side resin layer, and a groove forming step for forming drainage grooves in the felt-side resin layer.

Firstly, a resin layer is formed in the resin layer forming process. More specifically, in this step, a laminate body 1*a* is formed from the reinforcing fibrous base material layer 21, in which the annular and belt-shaped reinforcing fibrous base material 211 is embedded in a resin material, and the precursor 22*a* of the felt-side resin layer and the shoe-side resin layer 23 laminated as resin layer on either side of said reinforcing fibrous base material layer.

The laminate body 1*a* may be formed by any method; however, in the present embodiment, the shoe-side resin layer 23 is formed; the reinforcing fibrous base material 211 is arranged on one side of the shoe-side resin layer 23; a resin material is coated onto the reinforcing fibrous base material 211, impregnating and penetrating the same, whereby a laminate body is formed in which the reinforcing fibrous base material layer 21 and the shoe-side resin layer 23 are integrated; next, the precursor 22*a* of the felt-side resin layer is formed on the surface of the reinforcing fibrous base material layer 21 which faces the joining surface of the reinforcing fibrous base material layer 21 and the shoe-side resin layer 23.

Figure 2:
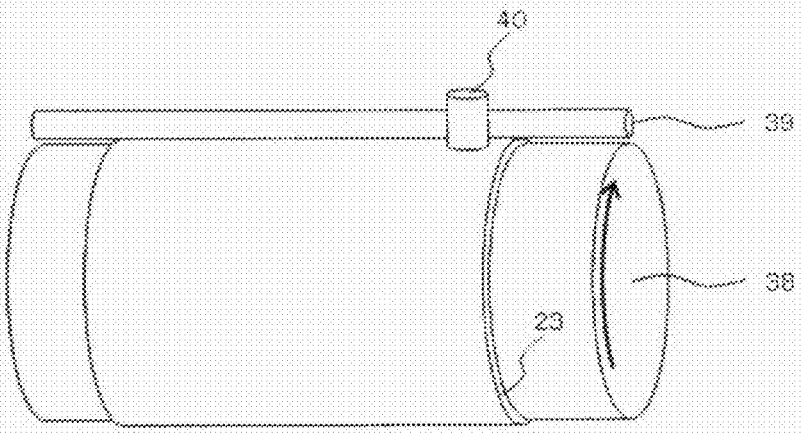
FIG. 2 is a schematic view for explaining one part (the laminating process) of a preferred embodiment of the method of manufacturing a shoe press belt according to the present invention.

Specifically, for example, first, as shown in FIG. 2, the shoe-side resin layer 23 is formed by coating a resin material onto the surface of a mandrel 38, onto which a releasing agent has been coated, while the mandrel 38 is being rotated so as to form a thickness of 0.8 to 3.5 mm, and by curing this coated layer of resin material for 0.5 to 1 hour at a temperature of 40 to 140° C.

Figure 3:
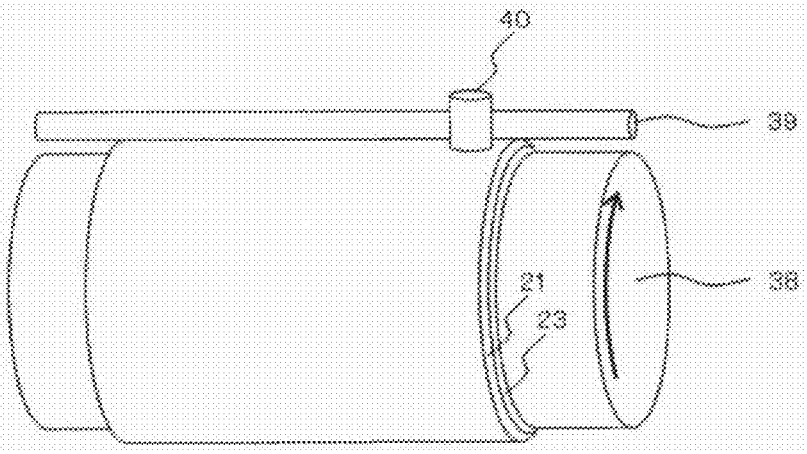
FIG. 3 is a schematic view for explaining one part (the laminating process) of a preferred embodiment of the method of manufacturing a shoe press belt according to the present invention.

Then, a reinforcing fibrous base material (not shown in the drawings) is arranged on top thereof; 0.5 to 2.0 mm of a resin material for forming the reinforcing fibrous base material layer 21 is coated while the mandrel 38 is being rotated as shown in FIG. 3; while the reinforcing fibrous base material is impregnated and penetrated by the resin material, it is bonded with the shoe-side resin layer 23; and a laminate body is formed in which the reinforcing fibrous base material layer 21 and the shoe-side resin layer 23 are integrated.

Figure 4:
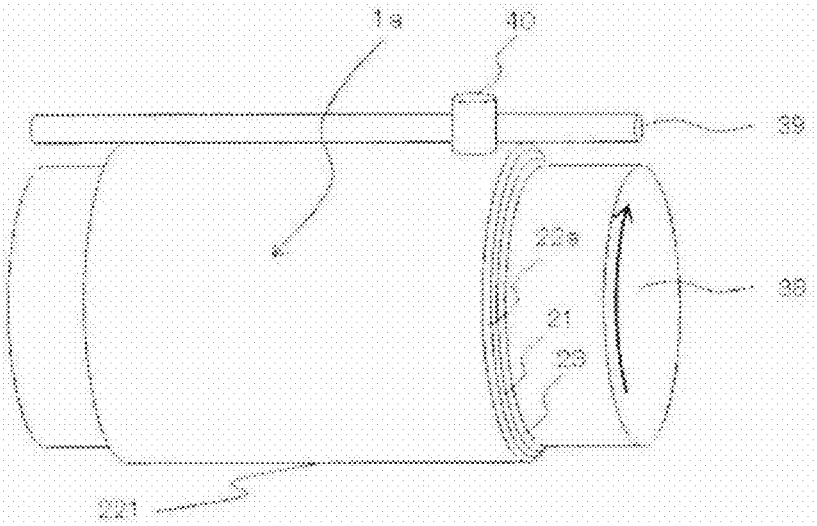
FIG. 4 is a schematic view for explaining one part (the laminating process) of a preferred embodiment of the method of manufacturing a shoe press belt according to the present invention.

Thereafter, a resin material for forming the felt side resin layer 22 is coated so as to form a thickness of 1.5 to 4 mm on the surface of the reinforcing fibrous base material layer 21, impregnating said reinforcing fibrous base material layer, while the mandrel 38 is being rotated, as shown in FIG. 4, and by curing this coated layer of resin material for 2 to 20 hours at a temperature of 70 to 140° C., the laminate body 1*a* is formed, which comprises the precursor 22*a* of the felt-side resin layer and a semifinished outer circumferential layer surface 221.

Any method may be used for coating the resin material; however, in the present embodiment, the coating is performed by applying the resin material onto each layer by ejecting it from the injection moulding nozzle 40 while the mandrel 38 is being rotated, and at the same time, the resin material is coated uniformly onto each layer using a coater bar 39.

The heating method is not particularly limited; however, for example, a heating method by far infrared heater can be used.

Moreover, the resin material may also be applied as a mixture with the above-mentioned inorganic fillers. Furthermore, the resin materials and fillers for forming each part of each layer may all be of the same type and constitution, or they may be different.

Next, in the groove forming step, drainage grooves are formed in the felt-side resin layer. Specifically, in this step, the drainage grooves 223 are formed in the outer surface (felt-contacting surface 221) of the laminate body 1*a*.

Figure 5:
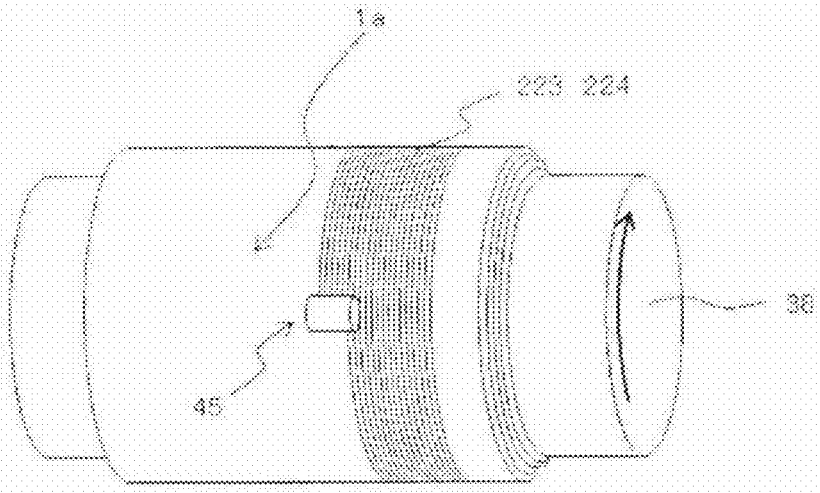
FIG. 5 is a schematic view for explaining one part (the drainage groove forming process) of a preferred embodiment of the method of manufacturing a shoe press belt according to the present invention.

Any method may be used for forming the drainage grooves 223; however, in the present embodiment, the outer surface of the laminate body 1*a* obtained as described above is machined by polishing and buffing (not shown in the drawings) to obtain the desired thickness of the shoe press belt 1; thereafter, the drainage grooves are formed and the shoe press belt 1 is completed by bringing a groove cutting device 45 to which a plurality of disk-shaped rotary blades has been attached into contact with the felt-side contacting surface 221 while the mandrel 38 is rotated, as shown for example in FIG. 5.

Moreover, the configuration of the drainage grooves 223 is not particularly limited; however, a plurality of parallel and continuous grooves is generally formed in parallel to the machine direction of the shoe press belt. For example, it is possible to set the groove width at 0.5 to 2.0 mm, the groove depth at 0.4 to 2.0 mm, and the number of grooves at 5 to 20 grooves per inch. Moreover, the sectional shape of the grooves may be suitably set to a rectangular, trapezoidal or U-shape, or the parts connecting the land parts, the bottom parts and the groove walls may be rounded, and the like.

Furthermore, the groove width, the groove depth, the number of grooves and the sectional shape of these drainage grooves may all be the same, or different configurations may be combined. Further, these drainage grooves may also be formed as non-continuous grooves; a plurality of parallel grooves may also be formed in the cross-machine direction.

As method of manufacturing a shoe press belt relating to an embodiment of the present invention, a method of manufacturing a shoe press belt will be explained, which comprises a resin layer forming step for forming the resin layers of the felt-side resin layer, the reinforcing fibrous base material layer and the shoe-side resin layer, and a groove forming step for forming drainage grooves in the felt-side resin layer.

Moreover, in the method of manufacturing a shoe press belt in the above-described embodiments, a method of manufacturing using a mandrel (1 roll) has been described; however, the shoe press belt can also be manufactured by a method in which an annular reinforcing fibrous base material is installed on 2 rolls arranged in parallel, wherein a shoe side resin layer is formed by coating, impregnating and laminating a resin on this reinforcing fibrous base material and wherein, after inversing this composite body, a felt-side resin layer is formed on the surface of the reinforcing fibrous base material layer and grooves are machined (2 roll manufacturing method). Furthermore, the order of forming the different resin layers may be selected at will.

Above, the present invention has been explained in detail based on the preferred embodiments; however, the present invention is not limited thereto, and as long as the same function is obtained, each constitution may be freely substituted or features may be freely added.

EXAMPLES

Hereinafter, the present invention will be explained in even greater detail by the examples; however, the present invention is not limited by these examples.

1. Production of a Polyurethane Specimen

First, the polyurethane specimens of Reference Examples 1 to 10 were produced from urethane prepolymers and the curing agents given in Table 1 to evaluate the physical properties of the polyurethanes for forming the shoe press belts.

In Reference Examples 1 to 10, specifically, a polyurethane sheet was obtained by mixing a urethane prepolymer with a curing agent, pouring the mixture into a mould of room temperature, heating to 140° C., pre-curing at 140° C. for 1 hour, removing the product from the mould, and by post-curing at 140° C. for 3 hours. The specimens (with 1.5 mm thickness for the tensile strength measurement, with 3.5 mm thickness for the crack growth rate measurement) of Reference Examples 1 to 10 were manufactured from the sheets obtained.

The JIS-A hardness, the tensile strength (JIS K6251: Dunbbel No. 3; tensile speed 500 mm/min) and the crack growth rate were evaluated. The results of the evaluations are shown in Table 1.

Figure 6:
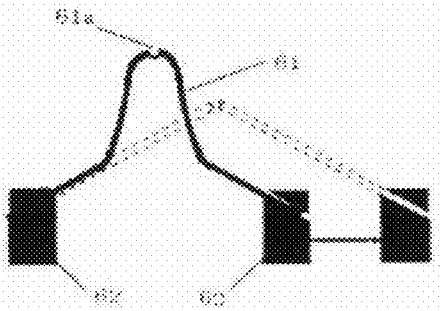
FIG. 6 is a schematic view of a test device for evaluating crack extension.

Moreover, the crack growth rate was evaluated by testing the crack extension with a test apparatus similar to the de Mattia flex tester defined under AS-K-6260 (2005), as shown in FIG. 6, at 20° C., under an atmosphere of 52% relative humidity and under the conditions described hereinafter.

The dimensions of a specimen 61 were: 25 mm width, 185 mm length (including an allowance of 20 mm for the grip on one side), 150 mm opening between the grips 62, 3.5 mm width; a semi-cylindrical indentation 61*a* of 1.5 mm radius was applied at the centre of the specimen. The travel of the back and forth movement was 65 mm between the greatest opening of the grips of 100 mm and the smallest opening of 35 mm; the speed of the back and forth movement was 360 back and forth movements/min. An incision of about 2 mm length was made in the width direction of the belt in the central part of the semi-cylindrical indentation of the specimen. The left and the right grips were provided so as to respectively form an angle of 45° C. with the direction of the back and forth movement. The flexing was repeated under these conditions and the length of the crack was measured after a prescribed number of strokes (test duration×speed of the back and forth movement). Moreover, the test was terminated when the length of the crack had exceeded 15 mm from the initial length of the incision (about 2 mm); the number of strokes at the time the crack length was 15 mm was read from the approximate curve of the stroke count and the crack length, and the crack growth rate (μm/stroke) was obtained by dividing the length to which the crack had grown (crack length 15 mm—the measured value of the initial length of the incision) by the stroke count at the time the crack length was 15 mm.

TABLE 1

| | Ref. Example 1 Example 1 | Ref. Example 7 Comp. Example 1 | Ref. Example 8 Comp. Example 2 | Ref. Example 9 Comp. Example. 3 | Ref. Example 10 Comp. Example 4 |
|---|---|---|---|---|---|
| Isocyanate | H6XDI | PPDI | MDI | TDI | TDI |
| Polyol | PCD | PCD | PCD | PCD | PCD |
| NCO % | 8.30 | 4.10 | 10.60 | 4.50 | 4.50 |
| Curing agent | BD:TMP = 9:1 | BD:TMP = 9:1 | BD:TMP = 9:1 | BD:TMP = 9:1 | DMTDA:TMP = 9:1 |
| Equivalent ratio (H/NCO) | 0.90 | 0.90 | 0.90 | 0.90 | 0.90 |
| Hardness (degrees, JIS-A) | 96 | 96 | 96 | 60 | 96 |
| Tensile strength (MPa) | 50 | 34 | 27 | 9 | 34 |
| Tensile elongation (%) | 501 | 344 | 252 | 516 | 287 |
| Tensile product (MPa) | 251 | 117 | 68 | 46 | 98 |
| Crack growth rate (μm/stroke) | 0.5 | 12.0 | 57.8 | 0.1 | 39.6 |
| Mechanical strength index (MPa · stroke/μm) | 502.0 | 9.8 | 1.2 | 460.0 | 2.5 |

| | Ref. Example 2 Example 2 | Ref. Example 3 Example 3 | Ref. Example 4 Example 4 | Ref. Example 5 Example 5 | Ref. Example 6 Example 6 |
|---|---|---|---|---|---|
| Isocyanate | H6XDI | H6XDI | H6XDI | H6XDI | H6XDI |
| Polyol | PCD | PCD | PTMG:PCD = 5:5 | PCD | PTMG |
| NCO % | 7.00 | 10.07 | 8.99 | 9.21 | 7.20 |
| Curing agent | BD | BD:TMP = 85:15 | MCDEA | CHDM | BD:Gly = 85:10 |

TABLE 1-continued

| | | | | | |
|---|---|---|---|---|---|
| Equivalent ratio (H/NCO) | 0.81 | 0.91 | 0.95 | 0.99 | 0.90 |
| Hardness (degrees, JIS-A) | 96 | 96 | 94 | 96 | 96 |
| Tensile strength (MPa) | 46 | 36 | 32 | 41 | 31 |
| Tensile elongation (%) | 340 | 314 | 331 | 459 | 342 |
| Tensile product (MPa) | 156 | 113 | 106 | 188 | 106 |
| Crack growth rate (μm/stroke) | 0.2 | 3.2 | 4.1 | 1.6 | 2.0 |
| Mechanical strength index (MPa · strokes/μm) | 780 | 35.3 | 25.9 | 117.5 | 53.0 |

2. Manufacture of a Shoe Press Belt

The resins of Reference Examples 1 to 6 were used to manufacture the shoe press belts of Examples 1 to 6, and the resins of Reference Examples 7 to 10 were used to manufacture the shoe press belts of Comparative Examples 1 to 4 by the method described hereinafter.

(1) Resin Layer Forming Step

The shoe-side resin layer was formed by coating a resin material to a thickness of 1.4 mm onto the surface of a mandrel with a diameter of 1,500 mm, which can be rotated by a suitable driving means, by an injection moulding nozzle which can move in parallel to the rotational axis of the mandrel while the mandrel was being rotated, and by performing a curing treatment (FIG. 2). Thereafter, the resin layer was allowed to remain at room temperature for 10 minutes while the mandrel kept on rotating, the temperature was raised to 140° C. by a heating device attached to the mandrel, and pre-heating was performed for 1 hour at 140° C.

Next, a grid-shaped material (warp yarn mesh: 1 yarn/cm, weft yarn mesh: 4 yarns/cm) made from multifilament twisted yarns of 5000 dtex polyethylene terephthalate fibers as weft yarns and multifilament yarns of 550 dtex polyethylene terephthalate fibers as warp yarns, wherein the warp yarns are sandwiched by the weft yarns and the intersecting parts of the weft and warp yarns are joined by a urethane resin adhesive, was arranged on the outer circumferential surface of the shoe-side resin layer without gaps so that the weft yarn was aligned along the axis direction of the mandrel. Then, a wound-yarn layer was formed by winding a multifilament yarn of 6700 dtex polyethylene terephthalate fibers in a helix shape at a pitch of 30 yarns/5 cm on the outer circumference of this grid-shaped material; the reinforcing fibrous base material was formed by the grid-like material and the wound-yarn layer. Thereafter, a resin material was coated, which was identical to the resin material of the shoe-side resin layer, so as to close the gaps of the reinforcing fibrous base material; a laminate body was formed in which the reinforcing fibrous base material layer and the shoe-side resin layer were integrated (FIG. 3).

Next, a laminate body was formed, in which the felt-side resin layer, the reinforcing fibrous base material layer and the shoe-side resin layer were integrated, by coating a resin material, which was identical to the resin material of the reinforcing fibrous base material layer and the shoe-side resin layer, from above the reinforcing fibrous base material layer by an injection molding nozzle, which can move in parallel to the rotational axis of the mandrel, to a thickness of about 2.5 mm, while the mandrel was being rotated, by impregnating the reinforcing fibrous base material with the resin material, and by performing a curing treatment (FIG. 4). During the curing treatment, the resin layer was allowed to remain at room temperature for 40 minutes while the mandrel kept on rotating, the temperature was further raised to 140° C. by a heating device attached to the mandrel, and heat curing was performed for 3 hours at 140° C.

Thereafter, a laminate body was obtained by polishing the felt-contacting surface of the felt-side resin layer so as to obtain a total thickness of 5.2 mm.

Moreover, the hardness of the resin of Reference Example 9 was too low to form the resin layer of a shoe press belt.

(2) Groove Forming Step

A shoe press belt was obtained by bringing a groove cutting device into contact with the felt-contacting surface of the felt-side resin layer of the laminate body obtained and by forming a plurality of drainage grooves (groove width 0.8 mm, groove depth 0.8 mm, pitch 2.54 mm) in the felt-side resin layer in the machine direction (MD) (FIG. 5).

By passing through the above steps, the shoe press belts of the Examples and Comparative Examples were obtained. The crack resistance and the resistance to land edge deficiency of the shoe press belts obtained were evaluated.

3. Crack Resistance Evaluation

Figure 7:
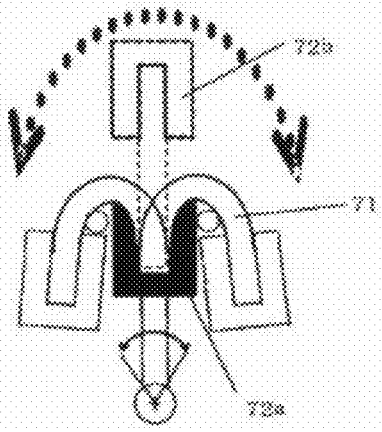
FIG. 7 is a schematic view of a test device for evaluating crack resistance.

The crack resistance was evaluated by performing a crack generating test using the flexural fatigue test device shown in FIG. 7, at 20° C., under an atmosphere of 52% relative humidity, and under the conditions described hereinafter. The dimensions of a specimen 71 were: 60 mm width and 70 mm opening between the grips. By giving a bottom grip **72*a* a back and forth movement in the shape of a circular arc, a top grip 72*b*** also moved back and forth in the form of a circular arc so as to fatigue the specimen by flexing at the front end of the bottom grip. The distance from the centre of the circular arc to the front end of the bottom grip was 168 mm, the distance moved by the lower grip was 161 mm, the speed of the back and forth movement was 162 strokes/minute. The weight of the top grip was 400 g. The specimen was repeatedly flexed under these conditions and the flexing strokes until cracks occurred were measured.

"A": Cracks did not occur even after 1 million strokes.

"B": Cracks occurred after 800,000 strokes.

"C": Cracks occurred after 500,000 strokes.

"D": Cracks occurred after 200,000 strokes.

The test results from the crack resistance evaluation of the Examples and Comparative Examples are shown in Table 2.

4. Evaluation of the Resistance to Land Edge Deficiency

Figure 8:
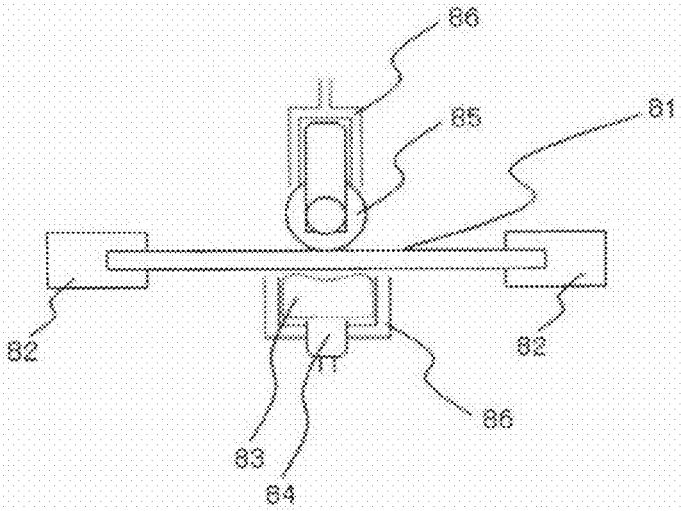
FIG. 8 is a schematic view of a test device for evaluating resistance to land edge deficiency.
Figure 9:
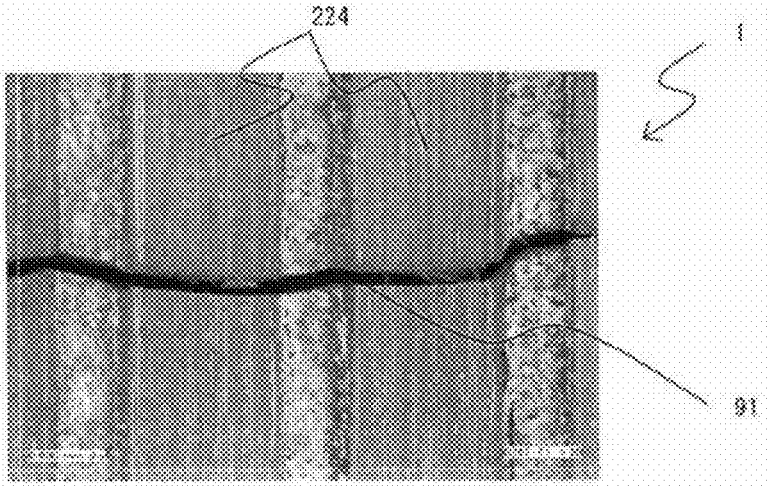
FIG. 9 is a photograph showing one example of a crack occurring in a shoe press belt.
Figure 10:
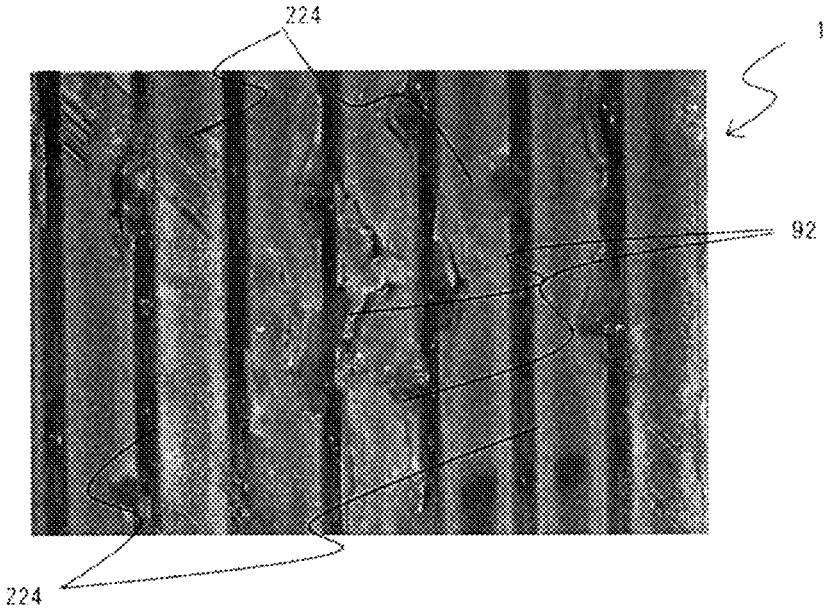
FIG. 10 is a photograph showing one example of land edge deficiency occurring in a shoe press belt.

The resistance to land edge deficiency was evaluated by performing a land edge deficiency generating test using the shoe-type fatigue testing device shown in FIG. 8, at 20° C., under an atmosphere of 52% relative humidity, and under the conditions described hereinafter. The dimensions of a specimen 81 were: 90 mm width and 40 mm opening between the grips. The left and right grips 82 were moved back and forth in a horizontal direction. Pressure was applied by a piston 84 on a shoe 83 only when the left and right grips 82 moved from left to right. A pressure of 70 kg/cm$^2$ was applied on the specimen 81 by the shoe 83 and a roll 85. The distance moved by the left and right grips was 170 mm, the speed of the back and forth movement was 57 back and forth movements/min, 500,000 back and forth movements were performed. Lubricating oil was supplied from the lubricating oil supply opening 86. The back and forth movements of the left and right grips were repeated under these conditions and the occurrence of land edge deficiency was measured. The land edge deficiency was evaluated as described hereinafter.

"A": Land edge deficiency did not occur.

"B": Land edge deficiency did not occur; however, there was abrasion.

"C": Land edge deficiency occurred.

The test results from the evaluation of the resistance to land edge deficiency of the Examples and the Comparative Examples are shown in Table 2.

TABLE 2

| | Example 1 | Compar. Example 1 | Compar. Example 2 | Compar. Example 3 | Compar. Example 4 |
|---|---|---|---|---|---|
| Crack resistance | A | C | D | — | D |
| Resistance to land edge deficiency | A | B | B | — | C |
| | **Example 2** | **Example 3** | **Example 4** | **Example 5** | **Example 6** |
| Crack resistance | A | B | B | A | A |
| Resistance to land edge deficiency | A | A | A | A | A |

As can be seen from Table 2, the shoe press belts relating to Examples 1 to 6 have improved crack resistance and resistance to land edge deficiency.

Moreover, the crack resistance and the resistance to land edge deficiency are profoundly related to the mechanical strength index shown in Table 1. A mechanical strength index of 10 or more is preferred, 25 or more is even more preferred and 50 or more is still more preferred.

DESCRIPTION OF THE REFERENCE CHARACTERS

1: shoe press belt, 1*a*: laminate body, 21: reinforcing fibrous base material layer, 211: reinforcing fibrous base material, 212: resin of the reinforcing fibrous base material layer, 22: felt-side resin layer, 22*a*: precursor of the felt-side resin layer, 222: resin of the felt-side layer, 223: drainage grooves, 224: felt-contacting surface of the groove land parts, 225: land edge parts, 23: shoe-side resin layer, 231: shoe-contacting surface, 232: resin of the shoe-side resin layer, 38: mandrel, 39: coater bar, 40: injection moulding nozzle, 45: groove cutting device, 61: specimen for evaluating crack growth, 61*a*: semi-cylindrical indentation (incision part, crack growth part), 62: grips of the device for evaluating crack growth, 71: specimen for evaluating crack resistance, 72*a, b*: grips of the device for evaluating crack resistance, 81: specimen for evaluating land edged deficiency, 82: grips of the device for evaluating land edge deficiency, 83: shoe, 84: piston, 85: roll, 86: lubricating oil supply opening, 91 crack, 92: land edge deficiency

The invention claimed is:

1. A shoe press belt, comprising a felt-side resin layer comprising a resin formed by curing a prepolymer having a terminal isocyanate group (—NCO) with a curing agent, wherein the prepolymer comprises, in reacted form, a compound comprising 1,4-bis(isocyanate methyl) cyclohexane and a polycarbonate diol, and wherein the felt-side resin layer comprises grooves that are configured to receive water squeezed from a felt.

2. The shoe press belt according to claim 1, wherein the hardness (JIS-A) of the felt-side resin layer is 90 degrees or more.

3. The shoe press belt according to claim 1, wherein the mechanical strength index of the resin constituting the felt-side resin layer, which is expressed by formula (1) below, is 10 (MPa·strokes/μm) or more $$\text{Mechanical strength index(MPa·strokes/μm)}=A\times B/C \quad (1),$$

wherein

A=tensile strength (MPa),

B=tensile elongation (%), and

C=de Mattia type crack growth rate (μm/stroke).

4. The shoe press belt according to claim 3, wherein the mechanical strength index of the resin constituting the felt-side resin layer, which is expressed by formula (1), is 25 (MPa·strokes/μm) or more.

5. The shoe press belt according to claim 3, wherein the mechanical strength index of the resin constituting the felt-side resin layer, which is expressed by formula (1), is 50 (MPa·strokes/μm) or more.

6. The shoe press belt according to claim 1, wherein the curing agent has a terminal active hydrogen group (—H), and wherein the equivalent ratio (H/NCO) of the active hydrogen group (—H) of the curing agent and the isocyanate group (—NCO) of the prepolymer is from 0.8 or more to 1.0 or less.

7. The shoe press belt according to claim 1, wherein the curing agent comprises one or more compounds selected from the group consisting of 1,4-butanediol, trimethylol propane, glycerine, 4,4'-methylenebis (3-chloro-2,6-diethylaniline), 1,4-cyclohexane dimethanol.

* * * * *